US005732669A

United States Patent [19]

Fischer et al.

[11] Patent Number: 5,732,669

[45] Date of Patent: Mar. 31, 1998

[54] VALVE CONTROL FOR AN INTERNAL COMBUSTION ENGINE

[75] Inventors: Gert Fischer, Feldafing; Johannes Hoehl, Maisach, both of Germany

[73] Assignee: Bayerische Motoren Werke Aktiengesellschaft, Germany

[21] Appl. No.: 771,924

[22] Filed: Dec. 23, 1996

Related U.S. Application Data

[63] Continuation of Ser. No. 648,827, May 16, 1996, abandoned, which is a continuation of Ser. No. 290,790, filed as PCT/EP93/03451, Dec. 8, 1993, abandoned.

[30] Foreign Application Priority Data

Dec. 13, 1992 [DE] Germany ..... 42 42 060.1

[51] Int. Cl.[6] ..... F01L 13/00

[52] U.S. Cl. ..... 123/90.16; 123/90.39

[58] Field of Search ..... 123/90.15, 90.16, 123/90.17, 90.27, 90.31, 90.39, 90.41, 90.42, 90.48, 90.5

[56] References Cited

U.S. PATENT DOCUMENTS

| | | | |
|---|---|---|---|
| 2,131,755 | 10/1938 | Roan . | |
| 2,266,077 | 12/1941 | Roan | 123/90.16 |
| 2,851,851 | 9/1958 | Smith | 123/90.16 |
| 2,880,712 | 4/1959 | Roan | 123/90.16 |
| 4,138,973 | 2/1979 | Luria | 123/90.16 |
| 4,469,056 | 9/1984 | Tourtelot, Jr. et al. | 123/90.16 |
| 4,530,318 | 7/1985 | Semple | 123/90.17 |
| 4,572,118 | 2/1986 | Baguena | 123/90.16 |
| 4,714,057 | 12/1987 | Wichart | 123/90.15 |
| 5,189,998 | 3/1993 | Hara | 123/90.16 |

FOREIGN PATENT DOCUMENTS

| | | |
|---|---|---|
| 885719 | 2/1981 | Belgium . |
| 2 500 528 | 8/1982 | France . |
| 470032 | 1/1929 | Germany . |

*Primary Examiner*—Weilun Lo

*Attorney, Agent, or Firm*—Evenson, McKeown, Edwards & Lenahan, P.L.L.C

[57] ABSTRACT

An internal combustion engine has a camshaft with control cams which act on respective valves through a transmission member whose contact path on the cam side is variable in its position relative to the control cam via a control device for changing the valve opening period with a valve lift that is essentially constant. To achieve exact control, the contact path is formed on a roller, which is forcibly controlled relative to the drag lever in synchronization with the camshaft, as an intermediate element between the control cams and the drag lever.

11 Claims, 4 Drawing Sheets

VALVE CONTROL FOR AN INTERNAL COMBUSTION ENGINE

This is a continuation of application Ser. No. 08/648,827, filed May 16, 1996, now abandoned, which is a continuation of application Ser. No. 08/290,790, filed as PCT/EP93/03451, Dec. 8, 1993 now abandoned.

BACKGROUND AND SUMMARY OF THE INVENTION

The present invention relates to a valve control for changing a valve opening period, with a valve lift that is variable within narrow limits as a function of the system.

In a valve control described in British Patent No. 955,988, a tappet is provided as a transmission member in a guide that is tiltable around an axis parallel to the camshaft by way of a control device as a function of rpm (rotational speed). The tappet is provided with a flat contact path and is tiltable both in and against the rotational direction of the camshaft, so that valve lift patterns with different valve opening periods are obtained. For rpm-dependent tilting of the guide in the same and in the opposite direction relative to the rotational direction of the camshaft, the control device is configured as a pin located eccentrically to and rotating with the camshaft. The pin cooperates with control arms mounted on the tappet guide that are relatively stiff yet elastically flexible.

To monitor the rpm-dependent tilting, the known guide is connected to a flexible stop. The stop, at low engine rpm, permits a tilting of the guide with the tappet by way of the control arms which are relatively inflexible by comparison, to reduce the valve opening period with possible elimination of valve overlap. However, at high engine rpm, the stop holds the guide with the tappet in a non-tilted position, with the control arms avoiding the approaching, eccentrically mounted pin in a flexible manner.

In this known valve control, the flexible control arms of the control device provided to control tilting as a function of rpm are disadvantageous. The arms, for all the cylinders in a multicylinder internal combustion engine, produce different valve opening periods at a given rpm, and therefore performance and exhaust quality are subject to unacceptable fluctuations.

In addition, a valve control is known from British Patent No. 649,192 for deliberate load- and rpm-dependent variation of the valve opening angle of a gas exhaust valve. This known valve control differs from the valve control described above in that the camshaft is equipped with an eccentrically mounted driver for radially movable engagement into a radial slot of a drive wheel separate from the camshaft. To change the valve opening angle, the drive wheel is displaced relative to the camshaft in a transverse direction, resulting in a non-uniform rotational speed of the camshaft coupled by the driver when the drive wheel is rotating constantly. This valve control based on the principle of constantly nonuniform rotational speed through deliberate offset of the components rotationally coupled with one another is disadvantageously costly to manufacture.

An object of the present invention is to provide in a valve control an improved control device for changing the valve opening periods with a valve lift variable within limits as a function of the system so that exact control is obtained at low manufacturing cost.

This object has been achieved by a control device arranged to rotate synchronously with a camshaft and to have a relatively adjustable angle of rotation, wherein the control device is in a driving relationship with an intermediate element having a contact path, movably guided between control cams and a transmission member over an arc segment in the transmission member which is substantially eccentric with an axis of the camshaft. The intermediate element at each valve lift is driven in the same direction and in the opposite direction under forced control relative to the rotating control cams. An advantage of the present invention resides in an exact control for changing the valve opening periods with a constantly rotating camshaft and control device shaft, with the exact control being achieved by a forcibly controlled driving connection between the uniformly rotating camshaft and control device shaft. This offers the additional advantage that, when the phase angle of the control shaft of the control device changes relative to the camshaft because of a lack of rotational uniformity, load peaks in the valve control are avoided.

In certain preferred embodiments of the invention, a valve control is provided in which the intermediate element located between the control cam and the transmission member on the valve side is a tilting segment mounted to be movable in an arc segment which is concentric with respect to the axis of the camshaft. A difference between embodiments of this general type resides in the rigid control arm being disposed relative to the valve lift direction. In one configuration, the rigid control arm is provided on the tilting segment extending transversely to the valve lift direction for advantageous use of a cam or eccentric drive with a simple design for forcible control of the tilting segment which is preferably movably mounted in a tappet by the arc segment concentric to the camshaft.

Unlike the present invention, the intermediate element or tilting segment forcibly controlled relative to the tappet described in DE-A 39 20 895 serves as part of a piercing four-bar linkage controlled through a coupling by a crank drive, cooperating with a flat contact path of the tappet, to change the lift of the tappet with simultaneous change in the valve opening period of the gas exhaust valve actuated by the tappet. However, the forcibly controlled tilting segment according to the invention is part of a pushing loop chain in which, as is known, each drive member has a hinge and a prismatic joint. In the pushing loop chain used according to the present invention, one pairing of joints is composed of the lift-actuated tappet with the tilting segment guided in the tappet around the axis of the camshaft by the concentric arc segment, the rigid forked control arm of said segment forming the second joint pair with the cam and eccentric. The pushing loop chain thus formed, in contrast to the aforementioned prior art, with a kinematically system-controlled valve lift that differs within narrow limits and has a different spread, permits a preferred change in the valve opening period.

According to another aspect of the present invention, a tilting segment with a control arm which is rigid and orientated in the valve lift direction, for forced control of the tilting segment, likewise permits the use of a circulating crank or eccentric drive. The difference with respect to the arrangement shown in the above-mentioned DE-A 39 20 895 is the mounting of the tilting segment in each transmission member in an arc segment concentric with respect to the axis of the camshaft for predominant changing of the valve opening period.

Instead of the intermediate element heretofore described as a tilting segment, the intermediate element can be configured as a roller mounted to be displaceable in or on the transmission member along the concentric arc segment. The roller, in contrast to the known device for changing cam spread according to Swiss Patent No. 390,617 (which corresponds to British Patent No. 969,297), is driven in the same direction and in the opposite direction with each valve lift, by way of a push rod of a crank or eccentric drive, rotating synchronously with the camshaft and with an adjustable rotational angle, of the control device between the control cam and the respective transmission member (tappet or valve lever) transversely to the valve lift direction relative to the rotating control cam, synchronously with forced control.

In the valve control according to the present invention, with a predetermined rotational angle arrangement of the control shaft of the control device, the shaft rotating synchronously with the camshaft of the control device, the roller, located on the transmission member side, moves under control relative to the acting control cam with its rotational direction, and in a rotational angle arrangement opposite thereto, the roller moves relative to the acting control cam under control opposite to its rotational direction. With the driven roller, controlled in the same direction relative to the control cam, in the transmission member, a valve lift pattern with large valve opening angles and long valve opening periods, like that advantageous for high performance development in internal combustion engines, is obtained. However, the roller in the transmission member which is driven under control in the opposite direction relative to the control cam, has a valve lift pattern with a small valve opening angle or a short valve opening period as a result, so that operation is advantageous, particularly at low engine rpm.

The roller in the transmission member which according to the present invention is displaceable in the same direction relative to the rotational direction of the control cam, for the tangent between the control cam and the contact path of the roller relative to a roller that is in fixed position, has a lower absolute speed, which, with a constant camshaft rpm, corresponds to a large valve opening angle. With the roller displaced in the opposite direction, the contour of the control cam is transmitted more rapidly to the transmission member and hence to the respective gas exhaust valve. For the tangent, therefore, a high absolute speed is obtained which corresponds to a small valve opening angle when the camshaft rpm is constant.

With regard to this change according to the invention in the valve opening angle of a gas exhaust valve, the above-mentioned Swiss Patent No. 390,617 offers no suggestions or hints, since the roller, controlled by push rods through an eccentric, is adjusted between the control cam and the arc segment of the tappet only discontinuously for simultaneous adjustment of the opening and closing times of the valve. This merely results in a change in cam spread, as is usual in modern devices for direct rotational angle changing of the camshaft relative to the crankshaft.

The valve control for the above-mentioned Swiss Patent No. 390,617, like the claimed valve control, corresponds kinematically to a pushing loop chain which, however, because of adaptation of the cam spread as a function of the operating point, with unchanged opening and closing times of the respective valve, is influenced under control only discontinuously or as required. Valve control of the above-mentioned British Patent No. 649,192 does permit changing the valve opening angle of a gas exhaust valve as a function of the operating point, but this is achieved kinematically in a different way with a circulating slider crank, in which two drive members rotating around parallel axes are coupled by a prismatic joint. Because the drive members of a pushing loop chain each comprise a hinge and a prismatic joint, a combination of the subjects of the two above-mentioned Swiss and British patent documents is not kinematically logical nor does it lead in an obvious manner to the valve control according to the present invention, by way of a deliberate change in the absolute speeds of the tangent between the control cam and the intermediate element by control, synchronous with the camshaft, of the intermediate element, to change the valve opening angle as a function of the operating point.

In a presently preferred embodiment of the present invention, the roller controlled relative to the control cam synchronously in the same and opposite directions is provided on a valve lever, preferably on a drag lever. In comparison with a conventional roller drag lever, the drag lever according to the present invention is characterized by an advantageously low profile. The advantage of the low profile, especially for a cylinder head, is further aided by the configuration of the push rods displacing the rollers which, by a forked shape, surround the drag lever in the lengthwise direction for an arrangement that is mainly flush at least in the base circle phase of the control cam. This arrangement of the drag lever and the roller push rod that is advantageous in one plane of a cylinder head, in addition to kinematic advantages of the control device, also results in kinetic advantages with an arrangement of the roller reversal points with the eccentric dead-center locations of the control shaft of the control device which produces, with an increasing number of eccentrics in a multivalve combustion chamber and/or a multicylinder internal combustion engine, a total torque which is balanced by balancing torques acting in opposite directions in sum. In an additional advantageous manner, this arrangement permits a simple lightweight driving device whose phase angle is controllable for the control shaft.

In an internal combustion engine in which both the intake and exhaust valves cooperate with drag levers that are equipped according to the invention with controlled rollers, the roller push rods on the intake side and the exhaust side can each be driven by means of a separate control shaft. Separate control shafts for controllable tilting levers for changing the opening times in exhaust valves and for changing the closing times for intake valves are known from U.S. Pat. No. 2,880,712, the subject matter of which is incorporated herein by reference.

A valve control that is advantageous as far as small space requirements and low construction cost are concerned with a single camshaft actuating roller drag lever configured according to the present invention for intake and exhaust valves is achieved by virtue of the fact that a single control shaft, fitted with an eccentric and adjustable in terms of its rotational angle, through forked push rods, controls both the rollers of the intake drag levers and the rollers of the exhaust drag levers relative to the respective control cams of the camshaft, synchronously in the same and opposite directions.

This control system can be provided especially advantageously in a cross-current cylinder head with an OHC arrangement in the area above the gas exhaust outlet ducts that generally run at an angle, whereby in this cylinder head the inlet ducts can be optimally configured.

BRIEF DESCRIPTION OF THE DRAWINGS

These and other objects, features and advantages of the present invention will become more apparent from the following detailed description thereof when taken in conjunction with the accompanying drawings wherein.

DETAILED DESCRIPTION OF THE DRAWINGS

Figure 1:
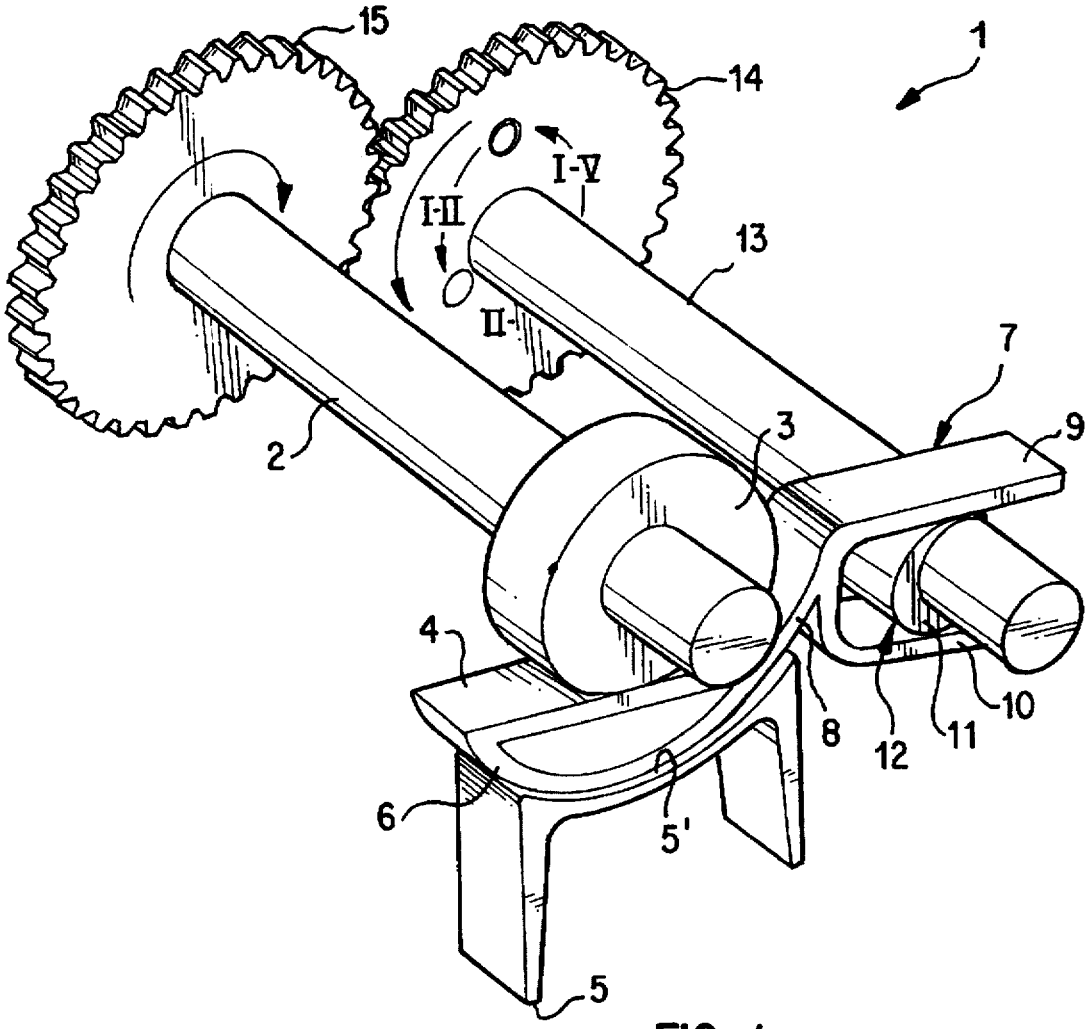
FIG. 1 is a schematic perspective view of a first valve control with a tappet equipped on the cam side with a tilting segment.

In FIG. 1, a valve control for a conventional gas exchange valve (not shown) of an internal combustion engine is designated generally by the numeral 1. Valve control 1 comprises a camshaft 2 with a control cam 3 which acts on a contact path 4 of a tappet 5 to open and close the valve.

Contact path 4 is formed on a tilting segment 6 tiltably mounted in tappet 5 in an arc segment 5' which is concentric with respect to camshaft 2. The segment 5' is part of a control device designated generally by the numeral 7 for changing the valve opening period with a lift of the gas exchange valve that is essentially constant as a function of the system. A rigid control arm 8 is provided on tilting segment 6 transversely to the valve lift direction. The arm 8 is in forcibly controlled (or desmodromic) driving connection by virtue of two forked free end segments 9 and 10 with a cam 12 shaped as an eccentric 11 therebetween.

Eccentric 11 is in a nonrotatable connection with a separate shaft 13 which is driven constantly and synchronously via a drive wheel 14 by a drive wheel 15 of camshaft 2. Eccentric shaft 13 is coupled with the drive wheel 14 by any conventional driving device (not shown), such that the phase angle of the eccentric 11 relative to the camshaft 2, for changing the valve opening period, is controllably changeable by approximately 180° in each case in one direction from I to II and finally from II back to I. Tilting control of the tilting segment 6, which serves to change valve opening periods with valve lift curves with a variable valve lift as a function of the system within limits, is superimposed on the tilting movement provided by the valve lift of the tappet 5 and the control 8 which is supported on the control device side. The degree of superimposed tilting movement is determined primarily from the lever spacing of the control arm 8 and the travel of the eccentric 11, which can also be made lift-adjustable relative to shaft 13 for additional different valve opening periods.

Figure 2:
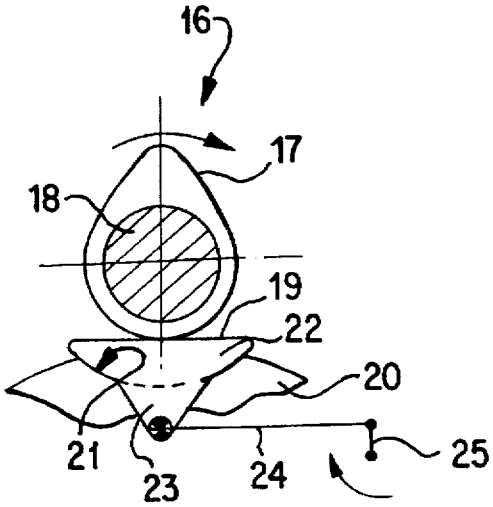
FIG. 2 is a schematic view of second valve control shown with a tilting segment which is modified with respect to the embodiment of FIG. 1.

In the valve control 16 shown schematically in FIG. 2, a control cam 17 of a camshaft 18 cooperates with contact path 19 of a tilting segment 22 mounted in a transmission member 20 (tappet or valve lever) by an arc segment 21 concentric with respect to camshaft 18. Tilting segment 22 is equipped with an approximately parallel rigid control arm 23 adjacent the transmission member 20 in the valve lift direction. The arm 23 is articulated on a pivot by a push rod 24 of a crank or eccentric drive 25 rotating synchronously with the camshaft 18 and having an adjustable rotational angle.

Figure 3:
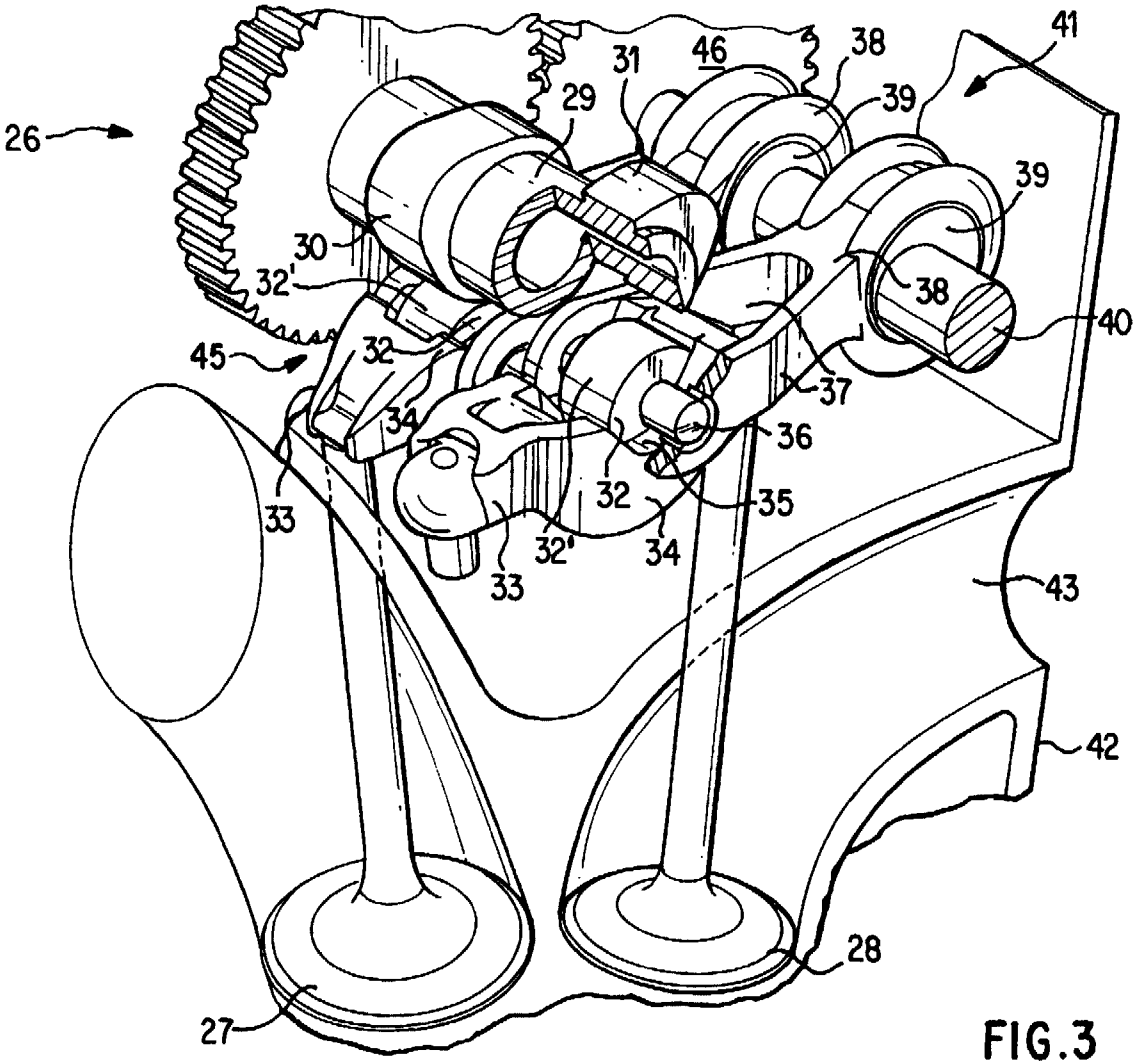
FIG. 3 is a perspective view of a third valve control embodiment with drag levers configured according to the present invention.
Figure 4:
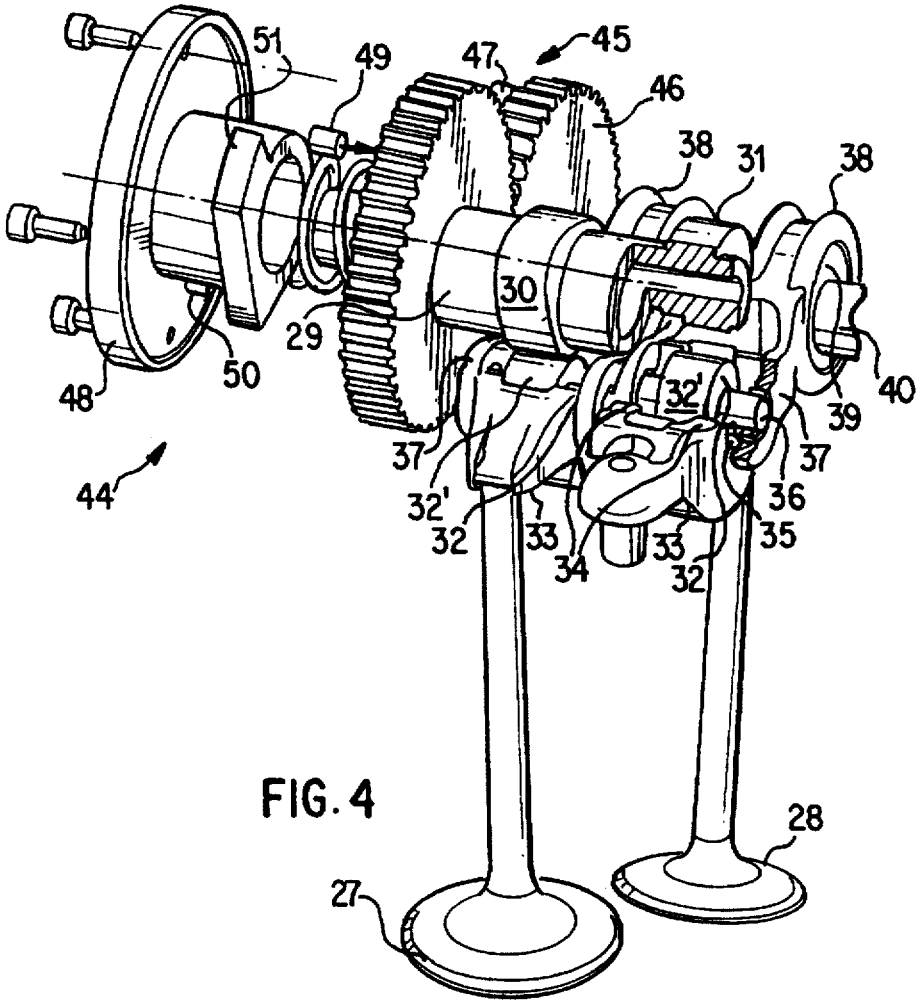
FIG. 4 is a perspective exploded view of the valve control according to FIG. 3 with a drive device.

A valve control designated generally by numeral 26 shown in FIGS. 3 and 4, comprises, for actuating an intake valve 27 and a exhaust valve 28, a common camshaft 29 with an intake control cam 30 and an exhaust control cam 31, each of which acts, via a respective roller 32 with a contact path 32', on a corresponding drag lever 33. Each of rollers 32 is located between ribs 34 in the associated drag lever 33. The ribs 34 have arc segments 35 which are concentric to the axis of the camshaft 29 and serve as guide paths for support pins 36 of rollers 32. Each support pin 36 is engaged by arms 37 of a forked push rod 38 that are located at both ends and on both sides of an associated drag lever 33. Each of push rods 38 is drivingly connected with an eccentric 39 of a shaft 40 of a control device 41 which is synchronously driven with respect to camshaft 29 and has an adjustable rotational angle.

As is evident from FIG. 3, a single eccentric shaft 40 serves to control the rollers 32 in the drag levers 33 on the intake and exhaust sides. The single eccentric shaft 40 of the control device 41, in a cross-current cylinder head 42 with OHC arrangement (that is merely indicated) (partially shown), is preferably located on the outlet side above the gas exhaust outlet channels 43 that are usually sharply curved. This arrangement requires a small amount of space and makes advantageously possible an arrangement of the drag lever 33 and the push rod 38 which is approximately flush in the base circle phase of the respective control cam 30, 31. This arrangement can also be used advantageously so that a reversal point of roller 32 in an end area of the arc segment 35 that is on the transmission member or drag lever side by a drive in the same or opposite direction and vice versa, as well as one of the two extreme positions, shifted by 180°, of eccentric 39 controlling push rod 38, are located on a line which essentially intersects the axis of eccentric shaft 40. The respective control cam 30, 31 is in a transversely directed position with respect to the lines which intersect the shaft 40.

Kinematically, there is advantageously achieved an essentially a harmonic drive of each roller 32, with only the slightest deviations in valve lift and spread, caused by the steering movements of the push rod 38. This arrangement has a kinetically favorable effect on the shaft 40 with an eccentric provided for the multiple gas exhaust valves of a multivalve combustion chamber and/or a multicylinder internal combustion engine. As a result, the balancing of torques acting in opposite directions achieves, in sum, an advantageously balanced total torque on the eccentric shaft 40.

This balanced total torque is of great importance for a driver device designated generally by numeral 44 in FIG. 4, which device is associated with the eccentric shaft 40 and has a controllable phase angle. As FIGS. 3 and 4 show, the eccentric shaft 40 is synchronously driven with camshaft 29 by a gear drive 45. It is most clearly seen in FIG. 4 that the driving device 44 is associated with the gear 46 on the eccentric shaft 40. Driving device 44 has two stop supports 47, 48 which are nonrotatably or fixedly connected with the eccentric shaft 40 and are arranged at a fixed axial distance apart, each having a driver stop 49 and 50. The driving device 44 also has an arm 51 which is nonrotatably but axially displaceably provided on the eccentric shaft 40 between the stop supports 47 and 48—the gear 46 is also stop support 47—for driving the stops 49, 50 offset by a predetermined rotational or phase angle, preferably by approximately 180°.

Figure 4A:
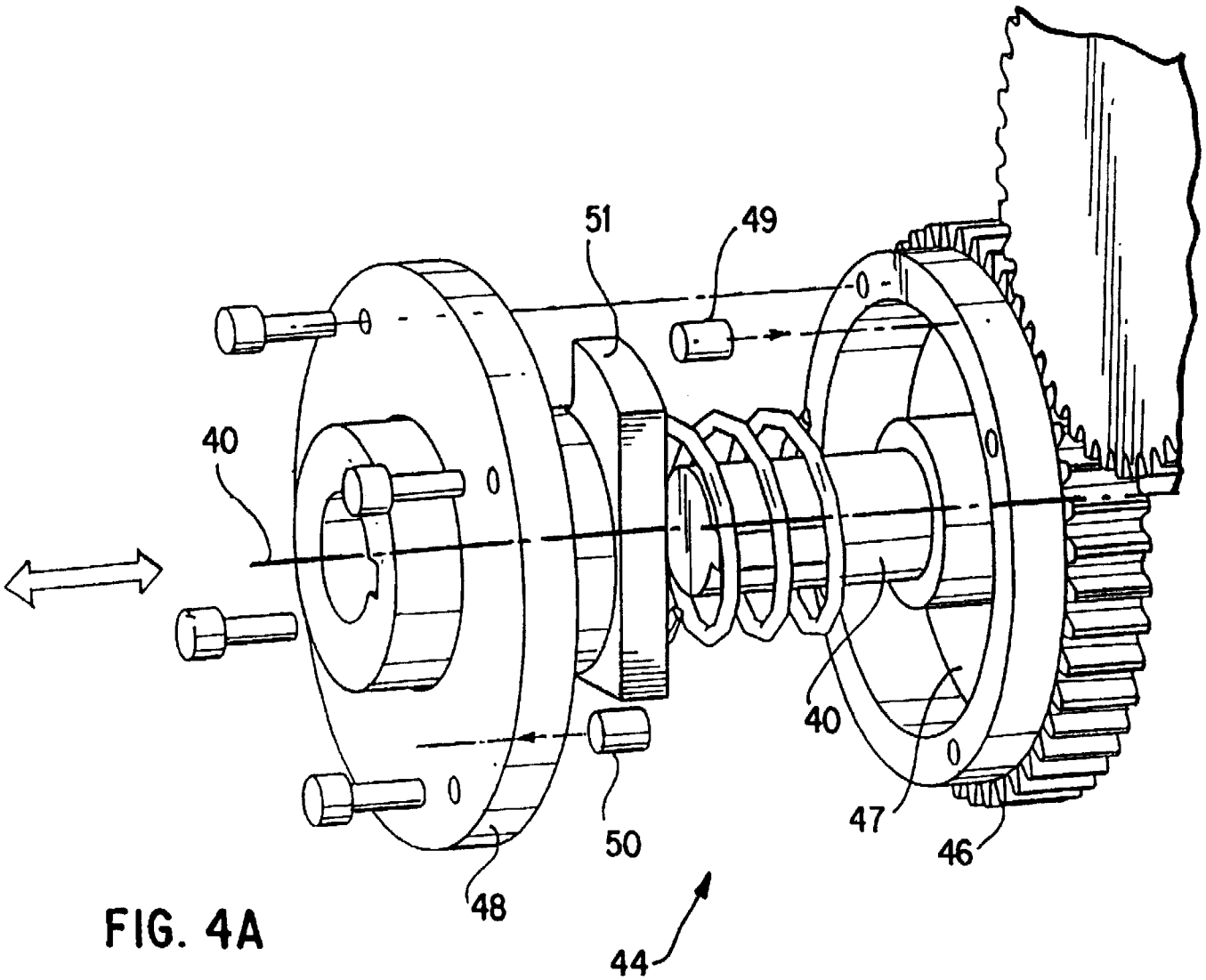
FIG. 4A is a perspective exploded view on an enlarged scale of the driver device shown in FIG. 4 but from a different viewing angle.

To adjust the rotational angle of the eccentric shaft 40 relative to camshaft 29, the arm 51 is, via a controlled axial displacement thereof in the direction of the double arrow in FIG. 4A, moved out of engagement with one of drive-integral stops 49, 50. The arm 51, which is now rotationally drive-less, is then struck by the other stop 50 or 49 and thereby rotationally entrained. This driving device 44, which is small, lightweight, and simple, results in the advantageously selected position of eccentric shaft 40 with respect to the rollers 32 which are synchronously displaced in the drag levers 33 along arc segments 35 in the same and opposite directions relative to the rotating control cams 30, 31.

Figure 5:
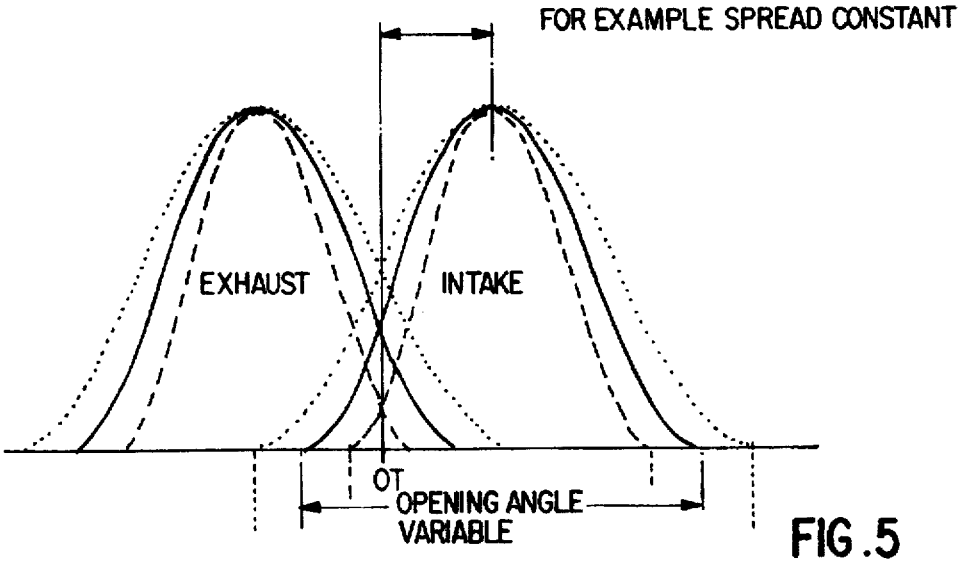
FIG. 5 is a graph of lift curves for intake and exhaust valves with modified opening and closing times, achieved with the valve controls of the present invention.

According to FIG. 5 it is a preferred object of the present invention to achieve, with each of the valve controls described above in an internal combustion engine at low rotational speeds, small valve opening angles with slight or small overlap, and at high rotational speeds, to achieve large valve opening angles with substantial overlap for obtaining high gas dynamics. Under the intake and exhaust valve lift curves shown in FIG. 5, the solid line valve lift curves correspond to the lift profile of the respective control cam 30, 31. These are variable with the valve control according to the invention with an intermediate element controlled in the same direction in synchronization with the respective control cam, in the direction of larger valve opening angle corresponding to the valve lift curves shown by the dotted lines and with an intermediate element controlled synchronously in the opposite direction, in the direction of smaller valve opening angles corresponding to the valve lift curves represented by dashes.

The valve control according to the present invention can, if necessary, be combined with a separate device for deliberate valve lift modification and/or deliberate spread change. This opens up the possibility, by way of a respectively independent control of the respective device, of being able to adjust a valve control optimally to a respective operating point of the internal combustion engine.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A valve control for an internal combustion engine, comprising a gas exchange valve, a transmission member associated with the gas exchange valve, a rotating control cam of a camshaft rotatable about a camshaft axis, the rotating control cam being arranged to actuate, via the transmission member, the gas exchange valve, an intermediate element containing a contact path which is contacted by the rotating control cam and which is arranged to be movable under control in one direction and in an opposite direction relative to the rotating control cam during a valve lift, and a control device arranged to rotate synchronously with said camshaft and configured to have an adjustable angle of rotation, wherein the control device is in a driving relationship with the intermediate element containing the contact path and is movably guided, between the control cam and the transmission member, over an arc-shaped segment of the transmission member, said arc-shaped segment being essentially concentric with a camshaft axis, said intermediate element at each valve lift being driven in the one direction and in the opposite direction under forced control relative to the rotating control cam.

2. The valve control according to claim 1, wherein the contact path is on a tilting segment movably connected with the transmission member via the arc segment with a rigid control arm transverse to a valve lift direction, a free end segment of the control arm cooperating with one of a cam and eccentric of the control device which rotates synchronously with respect to the camshaft for tilting control of the tilting segment such that the tilting movement of the tilting segment is further variable via the cam.

3. The valve control according to claim 1, wherein the control arm has fork-like free end sections, between which a cam configured as an eccentric is driven in rotationally movable manner by a shaft having a driving synchronous connection with the camshaft, the eccentric having a variable phase angle relative to the camshaft by a predetermined rotational angle value via a driving device, whose phase angle is arranged to be controlled, provided in the driving synchronous connection of said shaft with said camshaft.

4. The valve control according to claim 1, wherein the contact path is formed on a tilting segment movably connected with the transmission member via the intermediate element constituting an arc segment, with a rigid control arm parallel in the valve lift direction, on which a push rod of a crank or eccentric drive of the control device synchronously rotates with the camshaft and whose rotational angle is adjustable, is operatively associated with articulation, with the axis of the drive being provided approximately at half the lift of the transmission member.

5. The valve control according to claim 1, wherein a roller is displaceably guided with respect to said transmission member along concentric arc segments and constitutes the intermediate element with the contact path, said roller, via a push rod of a drive of control device, rotating synchronously with the camshaft which each valve lift, and with an adjustable rotational angle being driven in the same direction and in the opposite direction, synchronously positively controlled, between the control cams and the transmission member transversely to the valve lift direction relative to the rotating control cams.

6. The valve control according to claim 5, wherein the transmission member is a valve rocker lever with the roller located between ribs thereon and supported by a pin, said roller being displaceably arranged in the same direction and in the opposite direction along the concentric arc segments constituting guide paths of the pin, in the ribs via a control arm of the drive engaging the pin with a fork-shaped push rod engaging the pin at both ends with its arms located on both sides of the valve lever.

7. The valve control according to claim 5, wherein the transmission member supports the roller and is operatively associated with a shaft having an eccentric such that a reversal point of the roller is located in one end area of the arc-shaped segment on a side of the transmission member, and a phase-angle-controllable driving device is arranged in a driving connection of the shaft having the eccentric with the camshaft.

8. The valve control according to claim 7, wherein the transmission member is a valve rocker lever with the roller located between ribs on a lever and supported by a pin, said roller being displaceably arranged in the ribs along the concentric arc segments constituting guide paths of the pin, via a control arm of the drive engaging the pin with a fork-shaped push rod engaging the pin at both ends with its arms thereof located on both sides of the valve rocker lever.

9. The valve control according to claim 7, wherein the driving device comprises two stop supports, each with a driver stop on the shaft of the respective control device, nonrotatably and at a fixed axial distance apart, an arm provided nonrotatably and axially displaceably between the stop supports on the shaft for driving via one of the stops offset by a predetermined angle whereby the arm is moved out of engagement with one of the driver stops by a controlled axial displacement for adjusting a rotational angle of the shaft, such that the arm is driveless in a rotational direction and is contacted by the other driver stop for effecting rotational engagement.

10. The valve control according to claim 6, wherein the camshaft is a common camshaft for a respective rocker lever associated with the intake and exhaust valves and is arranged to act with each control cam on each rocker lever via the roller located in each rocker lever, the roller with respect to the camshaft constantly, synchronously controllable, in the same direction and in the opposite direction, whereby one shaft of the control device with the drive for the push-rod-controlled rollers of the rocker levers respectively associated with intake and exhaust valves rotates synchronously with the camshaft and has an adjustable rotational angle.

11. The valve control according to claim 10, wherein, in a cylinder head with an overhead cam arrangement, a single eccentric shaft of the drive for controlling one of the intermediate elements and the rollers for intake and exhaust valves is located in the area above the gas exhaust discharge ducts, whereby the shaft is in a driving connection with the camshaft, and a drive wheel of the eccentric shaft supports one of the stop supports of a driving device having a controllable phase angle.

* * * * *